US009695792B2

(12) United States Patent
Huberts et al.

(10) Patent No.: US 9,695,792 B2
(45) Date of Patent: Jul. 4, 2017

(54) SYSTEM AND METHOD FOR OPERATING AN IGNITION SYSTEM

(71) Applicant: Ford Global Technologies, LLC, Dearborn, MI (US)

(72) Inventors: Garlan J. Huberts, Milford, MI (US); Michael Damian Czekala, Canton, MI (US); Qiuping Qu, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 97 days.

(21) Appl. No.: 14/808,819

(22) Filed: Jul. 24, 2015

(65) Prior Publication Data

US 2017/0022959 A1 Jan. 26, 2017

(51) Int. Cl.
*F02P 9/00* (2006.01)
*F02P 3/05* (2006.01)

(52) U.S. Cl.
CPC ..... *F02P 3/05* (2013.01); *F02P 9/002* (2013.01)

(58) Field of Classification Search
CPC ..... F02P 3/05; F02P 3/04; F02P 9/002; F02P 11/025
USPC ..... 701/115
See application file for complete search history.

(56) References Cited

U.S. PATENT DOCUMENTS

| | | | | |
|---|---|---|---|---|
| 6,600,322 | B1 * | 7/2003 | Nussbaum | F02P 3/06 123/406.3 |
| 2006/0030993 | A1 | 2/2006 | Goodell et al. | |
| 2009/0071441 | A1 * | 3/2009 | Kiessling | F02P 9/005 123/406.53 |
| 2009/0126710 | A1 | 5/2009 | Alger, II et al. | |
| 2009/0260607 | A1 * | 10/2009 | LaDuke | F02P 9/002 123/609 |
| 2011/0247598 | A1 | 10/2011 | Tanaya | |
| 2014/0102412 | A1 * | 4/2014 | Czekala | F02P 3/04 123/406.12 |

* cited by examiner

*Primary Examiner* — Hai Huynh
*Assistant Examiner* — Gonzalo Laguarda
(74) *Attorney, Agent, or Firm* — Julia Voutyras; McCoy Russell LLP

(57) ABSTRACT

A system and method for mitigating the possibility of missing ignition coil commands is presented. In one example, one or more ignition coils may not be charged and/or discharged during a cylinder cycle in response to the absence of a voltage pulse forming at least a portion of an ignition coil command.

14 Claims, 7 Drawing Sheets

| STATE | COIL 2 | COIL 1 |
|---|---|---|
| 0 | 0 | 0 |
| 1 | 0 | 1 |
| 2 | 1 | 0 |
| 3 | 1 | 1 |

320

| STATE | COIL 2 | COIL 1 |
|---|---|---|
| 0 | 0 | 0 |
| 1 | 0 | 1 |
| 2 | 1 | 0 |
| 3 | 1 | 1 |

SYSTEM AND METHOD FOR OPERATING AN IGNITION SYSTEM

FIELD

The present description relates to a system and method for delivering spark to a spark ignited engine. The system and method may be particularly useful for engines that operate lean or with dilute mixtures.

BACKGROUND AND SUMMARY

A spark plug of a spark ignited engine may be supplied energy from two ignition coils. The two ignition coils may increase the spark energy and spark duration so that an engine may be operated with a lean air-fuel mixture or diluted (e.g., via exhaust gas recirculation (EGR)) to improve engine fuel economy and/or emissions. Each of the two ignition coils may be charged and discharged individually so that charging of one coil overlaps with charging of the other coil. Further, the second ignition coil may be discharged while the first ignition coil is being discharged to increase discharge current supplied to the spark plug.

One way to control each of the two ignition coils is to control current supplied to the two ignition coils via two control signals delivered via two conductors. However, the number of coil control conductors may be doubled as compared to an engine having one ignition coil per cylinder. Further, if the first control signal or second control signal is degraded for a particular engine cycle, the engine may misfire or begin combustion in a cylinder at an undesirable time due to undesirable spark timing. Therefore, it may be desirable to provide a way of operating two ignition coils without doubling a number of control wires and reducing a possibility of misfire if ignition coil signal degradation occurs.

The inventors herein have recognized the above-mentioned disadvantages and have developed a method for providing spark to an engine, comprising: commanding two different ignition coil charging current times via a single conductor and two ignition coil commands for a cylinder cycle; and ignoring the presence of at least one voltage pulse providing at least a portion of the two ignition coil commands in response to a voltage pulse missing from the two ignition coil commands.

By ignoring a pulse width of a first of two ignition coil commands, it may be possible to mitigate the possibility of engine misfire and undesirable combustion timing. For example, if a first portion of a first ignition coil command is absent, ignition coil charging may be inhibited or not started in response to the presence of a second portion of the first ignition coil command so that the ignition coil does not discharge during a subsequent cylinder cycle at a time coil discharge is not desirable. Similar mitigating actions may be taken if a second of the two ignition coil commands is absent or if a first portion of the first of the two ignition coil commands is absent.

The present description may provide several advantages. In particular, the approach reduces the possibility of providing spark to a cylinder at undesirable timing. Further, the approach, depending on circumstances, may still initiate coil discharging at a desirable time. Additionally, the approach may be performed in the proximity of ignition coils so that there may be a higher degree of confidence that the ignition coil commands are being properly processed and interpreted.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an example, referred to herein as the Detailed Description, when taken alone or with reference to the drawings, where.

DETAILED DESCRIPTION

Figure 1:
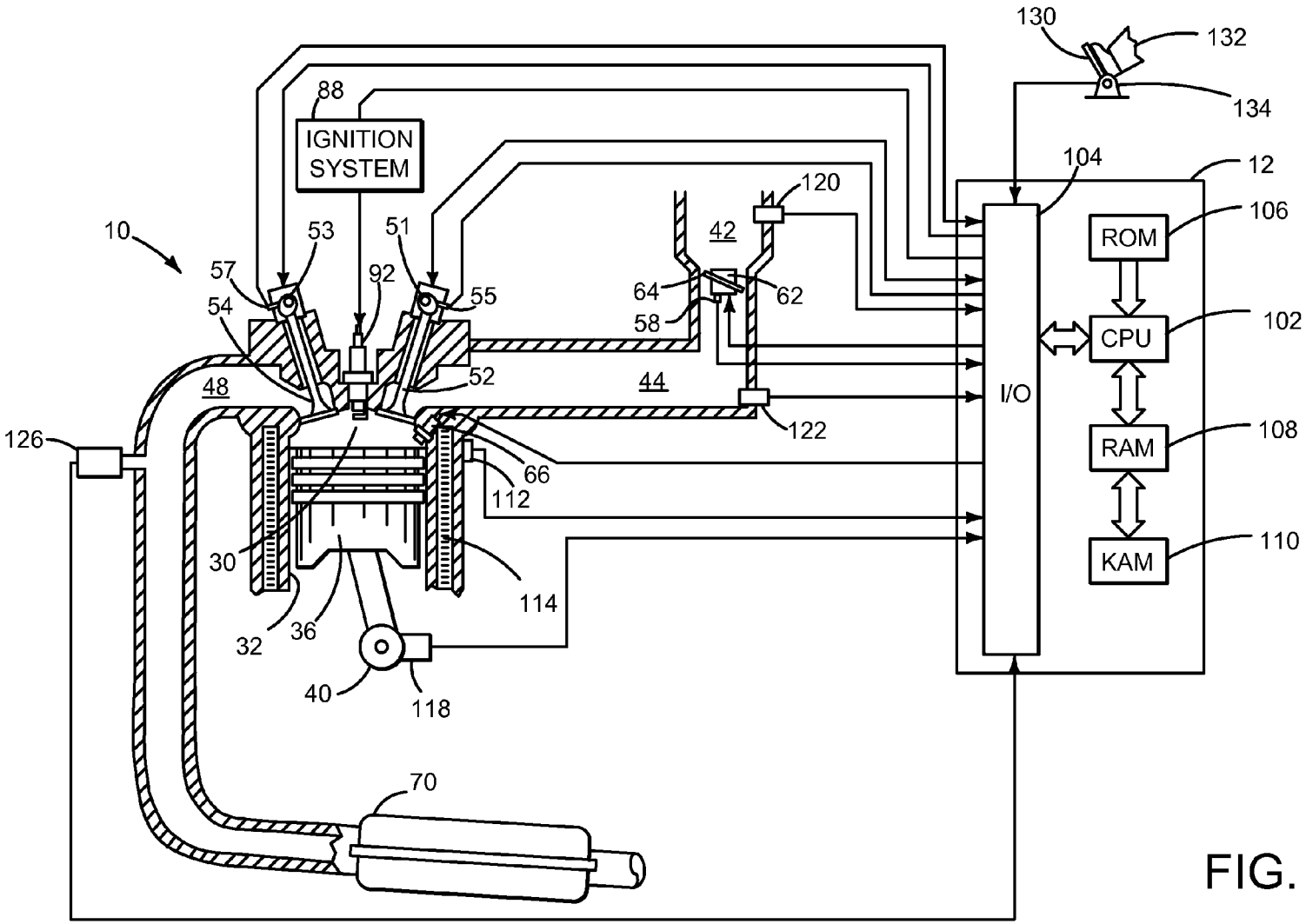
FIG. 1 is a schematic diagram of an engine.
Figure 2:
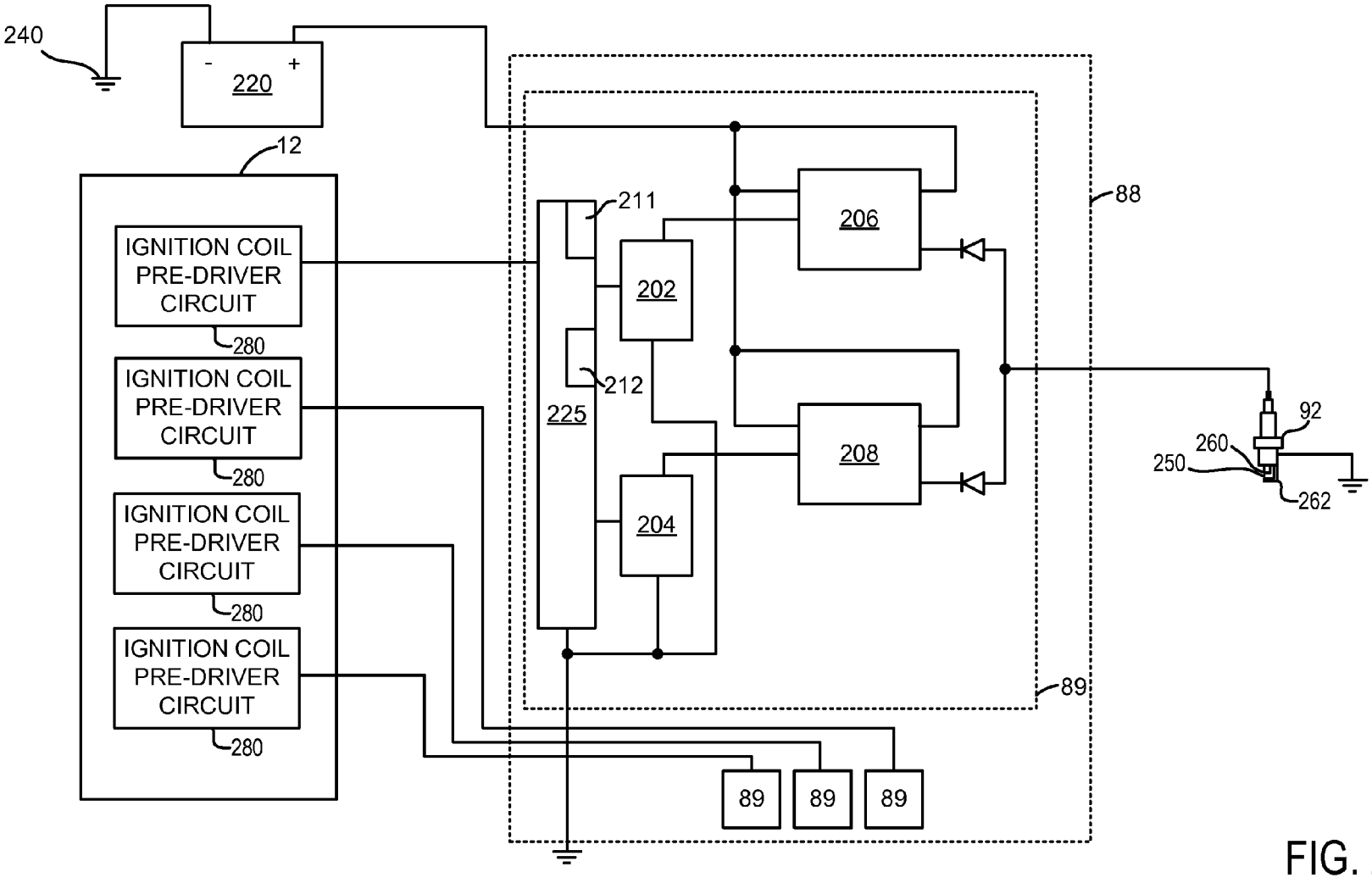
FIG. 2 is a schematic diagram of an ignition system.
Figure 3:
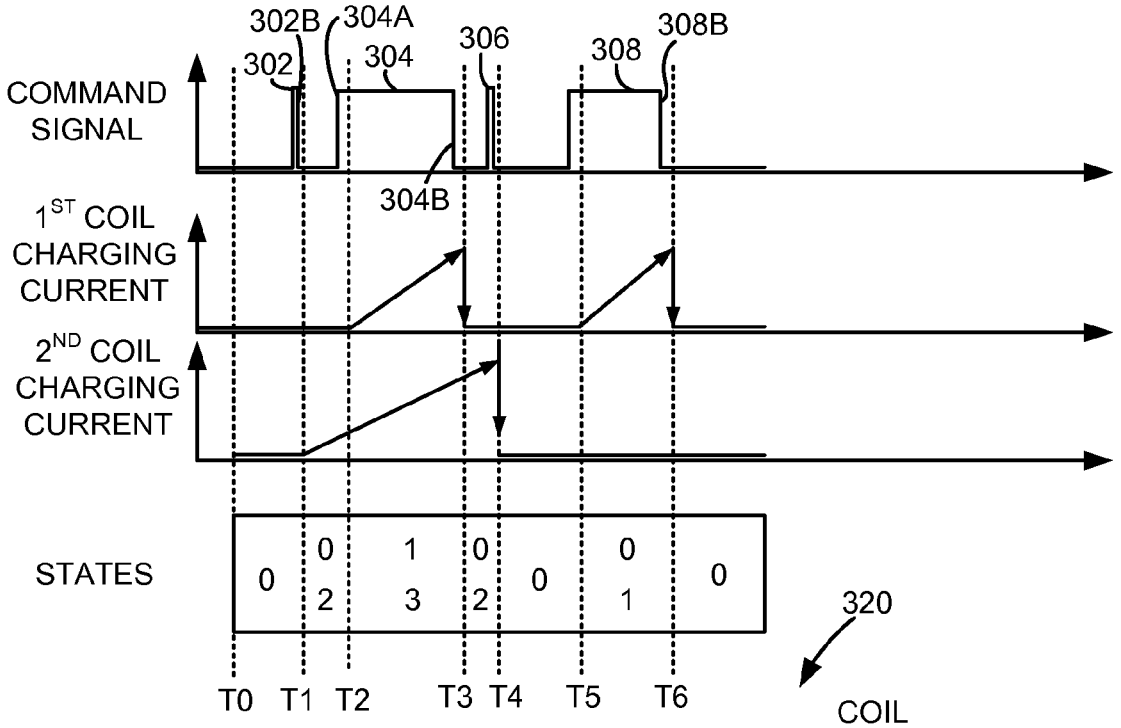
FIG. 3 is an example plot showing operation of the ignition system of FIG. 2.
Figure 4:
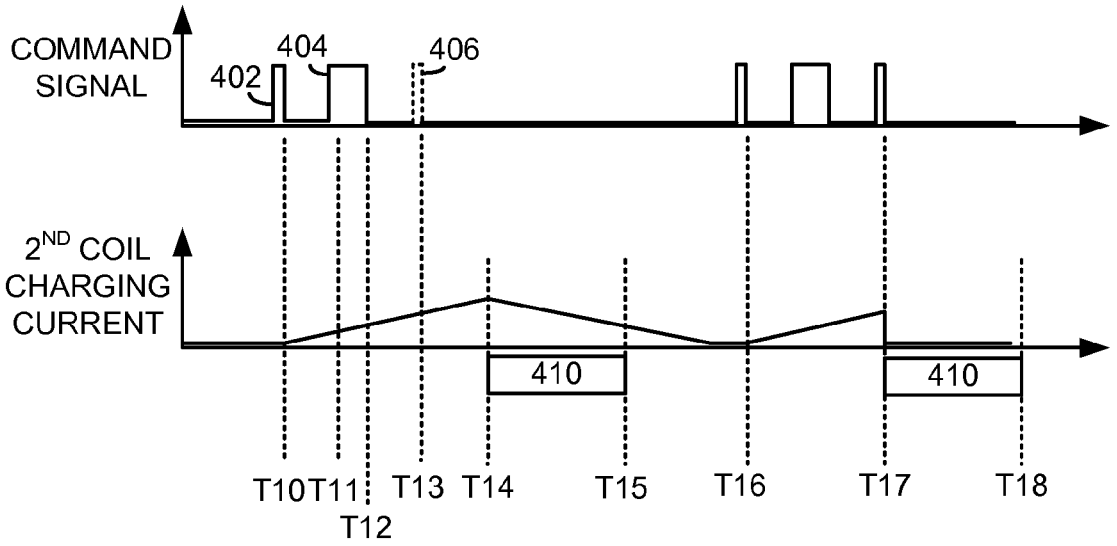
FIGS. 4-6 show plots of example ways to mitigate ignition system degradation according to the method of FIG. 7.
Figure 5:
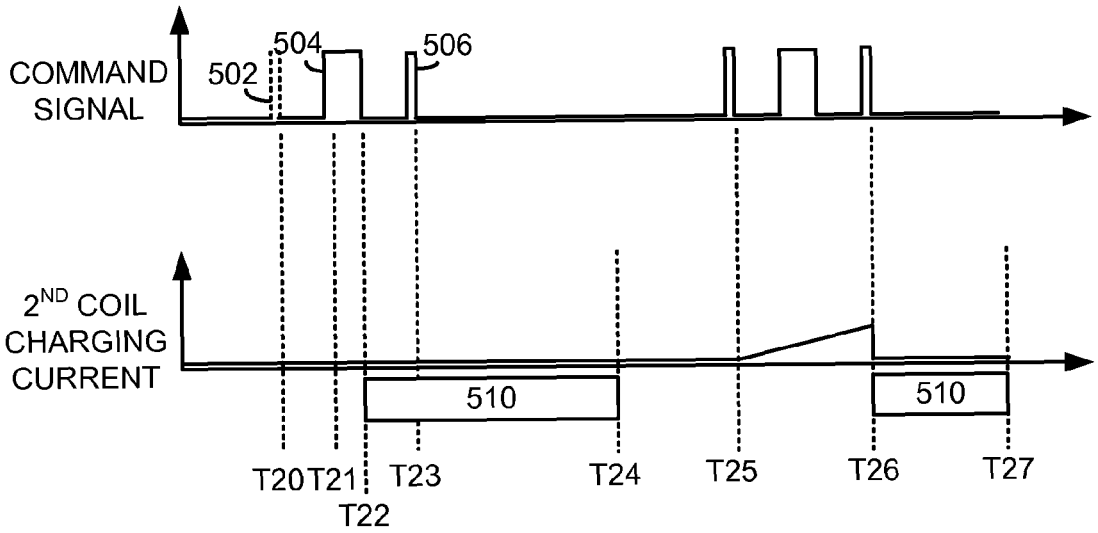
Figure 6:
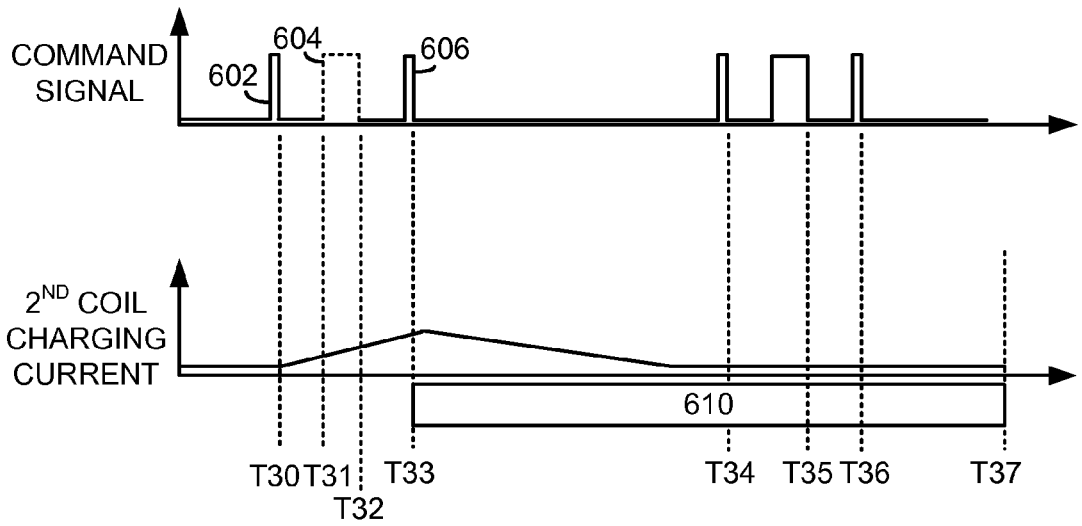
Figure 7:
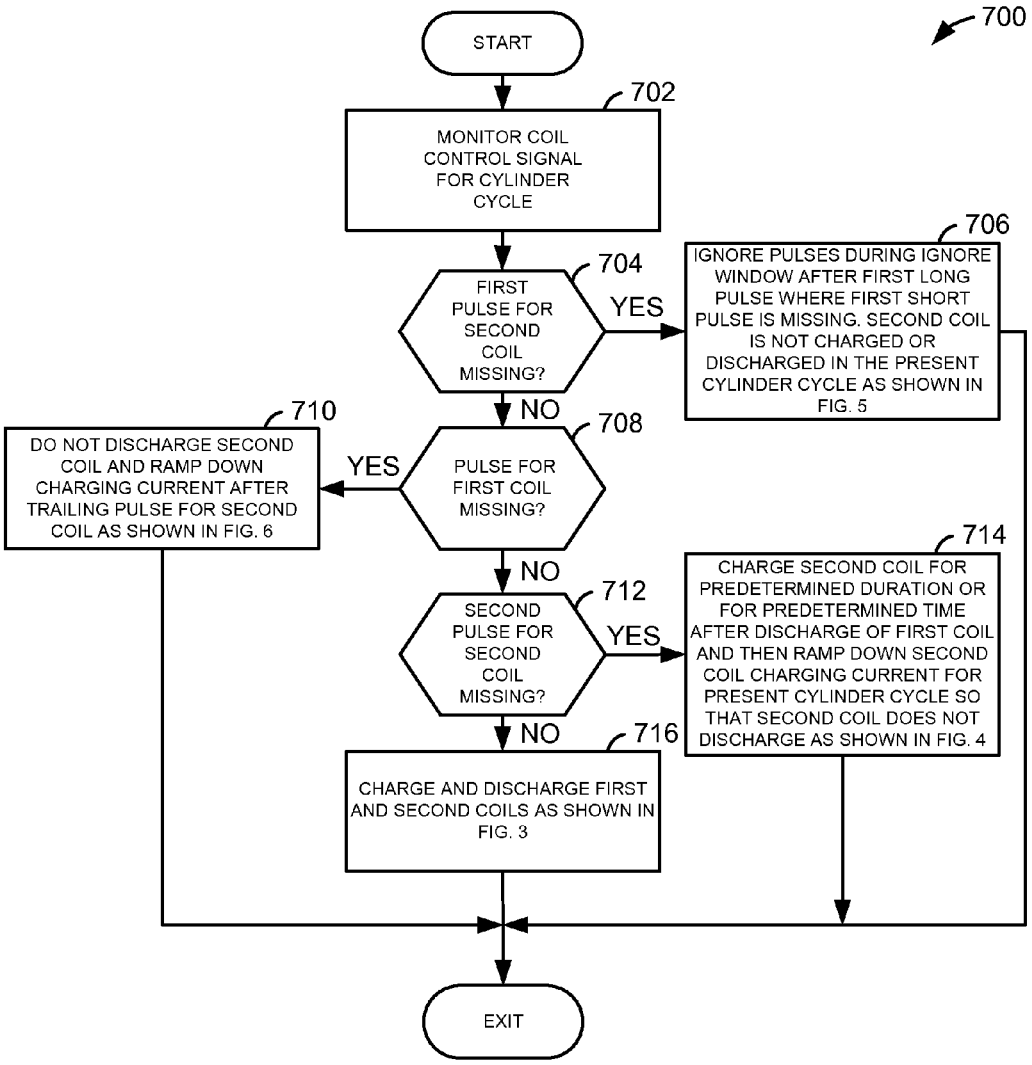
FIG. 7 shows a method for mitigating the possibility of undesirable spark events for a dual coil ignition system.

The present description is related to operating an ignition system of a spark ignited engine. In one non-limiting example, a control signal comprising a plurality of voltage pulses during a cylinder cycle is supplied to an ignition coil module via a single wire. The ignition coil module may selectively not charge and discharge an ignition coil in response to one or more missing voltage pulses. FIG. 1 shows an example engine and ignition system. FIG. 2 shows a detailed view of the ignition system shown in FIG. 1. An example ignition system control sequence is shown in FIG. 3. The possibility of improperly timed spark may be reduced as shown in the sequences of FIGS. 4-6. A method for reducing the possibility of improperly timed spark is shown in FIG. 7.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of adjustable intake cam 51 may be determined by intake cam sensor 55. The position of adjustable exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to a pulse width of a signal from controller 12. Fuel is delivered to fuel injector 66 by a fuel system (not shown) including a fuel tank, fuel pump, and fuel rail (not shown).

In addition, intake manifold 44 is shown communicating with optional electronic throttle 62 which adjusts a position of throttle plate 64 to control air flow from air intake 42 to intake manifold 44.

Distributorless ignition system 88 provides an ignition spark to combustion chamber 30 via spark plug 92 in response to commands from controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In one aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example the engine may be turbocharged or supercharged.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, is a schematic of an example ignition system. In this example, controller 12 includes an ignition coil pre-driver circuits 280, one for each ignition coil module 89 that may be operated to supply electrical energy to a spark plug of a single cylinder. The ignition coil pre-driver circuit 280 supplies a control signal comprising voltage pulses to interpretive logic 225. Where the engine includes N cylinders, N ignition coil pre-driver circuits provide control signals for ignition modules 89. In this example, four ignition coil modules 89 are supplied control signals via four ignition coil pre-driver circuits 280. One ignition coil module 89 is shown in detail. Interpretive logic 225 may be included in a programmable hardware logic array 211 or as part of executable instructions stored in non-transitory memory of a central processing unit 212. Interpretive logic 225 monitors the timing and level of a signal provided by pre-driver circuit 280 as described in FIGS. 4-7. In one non-limiting example, the timing of the signal provided by pre-driver circuit 280 may be as described in FIG. 3.

For example, interpretive logic 225 changes a state of a signal supplied to ignition coil driver 202 in response to a voltage pulse of a second ignition coil command of the ignition command signal. Interpretive logic changes a state of a signal supplied to ignition coil driver 204 in response to voltage pulses of a first ignition coil command of the ignition command signal. Interpretive logic 225 may output individual signals to ignition coil drivers 202 and 204. The signals supplied to ignition coil drivers 202 and 204 by interpretive logic 225 are synchronous with cylinder strokes of the cylinder being supplied spark via first ignition coil 206 and second ignition coil 208. In one example, at least one spark is provided during each cycle of the cylinder receiving spark from first ignition coil 206 and/or second ignition coil 208. For example, a spark may be supplied once a cylinder cycle during a compression stoke of the cylinder receiving spark. Further, in one example, first ignition coil 206 has a different inductance than second ignition coil 208.

Ignition coil drivers 202 and 204 are included in ignition system ignition coil module 89 which may be positioned on top of or near spark plug 92. Electric energy storage device 220 sources electrical current to first ignition coil 206. Second ignition coil 208 is selectively supplied current via second coil driver 204. Electric energy storage device 220 sources electrical current to second ignition coil 208.

Spark plug 92 may be supplied electrical energy from first ignition coil 206 and/or second ignition coil 208. Spark plug 92 includes a first electrode 260 and a second electrode 262. Second electrode 262 may be in continuous electrical communication with ground 240. A spark may develop across gap 250 when an electrical potential difference exists between first electrode 260 and second electrode 262.

Thus, the system of FIGS. 1 and 2 provides for a system for supplying spark to an engine, comprising: a ignition coil pre-driver circuit; interpretive logic that is in electrical communication with the first ignition coil pre-driver circuit, the interpretive logic including two ignition coil driver outputs, the interpretive logic including logic to ignore the presence of at least one voltage pulse providing at least a portion of two ignition coil commands from the ignition coil pre-driver circuit in response to a voltage pulse missing from the two ignition coil commands. The system includes where the interpretive logic is hardware logic. The system includes where the interpretive logic includes executable instructions stored in non-transitory controller memory. The system includes where the interpretive logic is in electrical communication with two ignition coil drivers. The system includes where the two ignition coil drivers are in electrical communication with two ignition coils. The system includes where the two ignition coils are in electrical communication with a sole spark plug.

Referring now to FIG. 3, a plot showing control signals for an ignition system that includes two ignition coils (e.g., the system of FIG. 2) via receiving commands for the two ignition coils via a single conductor during a single cylinder cycle. The signals represent signals that control the two coils (e.g., 206 and 208 of FIG. 2) that provide spark to a single cylinder (e.g., cylinder number one). The signals shown are for one cylinder cycle where ignition system degradation is not present. Signals for other engine cylinders similar to those shown are also provided. Vertical markers T0-T6 represent times of particular interest during the sequence.

The first plot from the top of FIG. 3 shows an ignition coil command signal provided via a single conductor that is the basis for operating the first and second ignition coils supplying electrical energy to a single spark plug. The ignition coil command signal timing changes in response to engine speed, engine load, engine combustion mode (e.g., lean or dilute) among other variables.

The second plot from the top of FIG. 3 shows a first ignition coil charging current. The charging current flows into a primary coil in the first ignition coil. A dwell time is an amount of time that charging current flows into the ignition coil. Electrical energy is being stored in the first ignition coil of two ignition coils supplying energy to a spark plug when charging current flows into the first ignition coil. The amount of energy stored in the first ignition coil increases as the charging current moves in the direction of the vertical axis arrow. The first ignition coil is not charging when the first charging current is at a lower level near the horizontal axis.

The third plot from the top of FIG. 3 shows a second ignition coil charging current. The second ignition coil of the two ignition coils supplying energy to the lone spark plug is charging when the second coil charging current is increasing. The second ignition coil is increasing when the second ignition coil charging current signal is increasing in the direction of the vertical axis arrow. The second ignition coil is not charging when the second ignition coil charging current signal is at a lower level near the horizontal axis.

The fourth plot from the top of FIG. 3 represents potential operating states for the first and second ignition coils. The operating states correspond to operation of the first and second ignition coils according to the state table 320. For example, in state number two, only the second ignition coil is being charged. In state number three, both the first and second ignition coils are being charged.

At time T0, both ignition coils are not being charged and the command signal is at a lower level. The operating state is zero indicating the ignition coils are not charging or commanded to charge.

Between time T0 and time T1, a first voltage pulse 302 during a cylinder cycle is provided. The first voltage pulse is a short duration pulse (e.g., less than 75 microseconds), and it indicates a beginning of charging of a second ignition coil for the cylinder cycle. Because the first pulse 302 is less than 75 microseconds, it may be interpreted solely as a command for the second ignition coil (e.g., ignition coil 208 of FIG. 1). Further, it is a first portion of a command for operating the second ignition coil because it provides a starting time or engine position for charging the second ignition coil, but it does not provide a stopping time or engine position for discharging the second ignition coil. The second ignition coil begins to charge after falling edge 302B transitions to a low level. The ignition coil state is a value of zero to indicate ignition coil 1 and ignition coil 2 are not activated. Shortly before time T1, the first voltage pulse 302 ends by transitioning to a low level.

At time T1, the second ignition coil (e.g., 208 of FIG. 2) begins to charge by providing battery power to the second ignition coil via ignition coil driver 204 in response to first voltage pulse 302. In particular, the charging current of the second ignition coil begins to increase. The first coil is not charging because the first coil charging coil is zero. The potential coil states are zero and two. If the first voltage pulse 302 was missing, the coil state would be zero. However, since the first voltage pulse 302 is present, the coil state is two.

Between time T1 and time T2, the second voltage pulse 304 occurs. The second voltage pulse 304 is a long duration pulse (e.g., greater than 105 microseconds). Because the second pulse 304 is greater than 75 microseconds, it may be interpreted solely as a command for the first ignition coil (e.g., ignition coil 206 of FIG. 1). The rising edge 304A identifies start of charging for ignition the first ignition coil. The falling edge 304B identifies stop of charging or discharge time for the first ignition coil. The potential coil states are one and three.

At time T2, the first ignition coil begins to charge in response to the second voltage pulse 304. The first ignition coil may begin to charge after the 105 micro-second time duration has been exceeded via the second voltage pulse 304. Thus, in this example, the first ignition coil and the second ignition coil are charging at time T2. If the first voltage pulse 302 was not present and second voltage pulse 304 was present for the cylinder cycle, the coil state would be one. The coil state is three when the first pulse 302 and the second pulse 304 are present.

Between time T2 and time T3, the second voltage pulse 304 ends. The second voltage pulse ends at falling edge 304B. The second ignition coil continues to charge.

At time T3, a spark is initiated at the spark plug in response to the second voltage pulse ending. The ending time of second voltage pulse 304 corresponds to a desired spark timing crankshaft angle (e.g., 15 degrees advanced of top dead center for the cylinder receiving the spark). The second ignition coil continues to charge after the first ignition coil begins to discharge.

Between time T3 and time T4, a third voltage pulse 306 for the cylinder cycle occurs. The third voltage pulse 306 is a short duration pulse (e.g., less than 75 microseconds). The third voltage pulse 306 indicates an ending time for charging the second ignition coil. Thus, the third voltage pulse 306 is a second portion of a command for operating the second ignition coil. Alternatively, first voltage pulse 302 may be interpreted as a first command to operate the second ignition coil for the cylinder cycle, and third voltage pulse 306 may be interpreted as a second command to operate the second ignition coil for the cylinder cycle. If the first voltage pulse 302 was not present, the coil state would be zero. The coil state is two when the first pulse 302 is present.

At time T4, the second ignition coil is discharged in response to the third voltage pulse 306. Thus, both the first and second ignition coils are discharged before time T4. The first and second ignition coils are discharged during a same cylinder cycle and the commands to charge and discharge the respective first and second ignition coils also occur during the same cylinder cycle.

Between time T4 and time T5, both the first and second ignition coils are discharging. Voltage pulse 308 is a long duration pulse (e.g., 105 microseconds). Therefore, it is determined to be a command for the first ignition coil (e.g., 206 of FIG. 1). This starts the recharging of the first ignition coil for restriking of the spark plug during the same cylinder cycle. Since the first ignition coil is typically a low inductance coil, it can be recharged quickly and recharging and restriking may occur repeatedly during the same cylinder cycle at lower engine speeds (e.g., less than 2000 RPM).

At time T5, the first ignition coil begins to recharge. The second ignition coil is not charging and the ignition state is one. However, if pulse 308 had not been sent, the ignition state would have been zero since short duration voltages have not been sent for the second ignition coil.

Between time T5 and time T6, the first voltage pulse for the second cylinder ends by transitioning to a lower level. The falling edge 308B is at a time that represents a desired angle of spark augmentation. The second ignition coil is not charged for the entire duration of the restrike period.

At time T6, the first ignition coil is discharged for restrike spark augmentation. The cylinder cycle ends after time T6 and a new cylinder cycle begins. The ignition state is zero since the first and second ignition coils are discharged.

In this way, two ignition coils may be selectively charged and discharged to during a cylinder cycle to vary an amount of electrical energy supplied to a spark plug during a cylinder cycle. Control commands for the two ignition coils may be provided over a single conductor to reduce wiring and system complexity.

Referring now to FIG. 4, an example plot showing a way to mitigate ignition system degradation is shown. In particular, FIG. 4 shows example signals during conditions when a second short duration voltage pulse during a cylinder cycle (e.g., the third voltage pulse in the cylinder cycle) is not present or is missing. The sequence of FIG. 4 may be provided by the method of FIG. 7 as part of the system of FIGS. 1 and 2. Vertical lines from time T10-T18 represent times of interest in the sequence. A first cylinder cycle begins at a time before T10 and ends before time T16. A second cylinder cycle begins at the end of the first cylinder cycle before time T16.

The first plot from the top of FIG. 4 shows an ignition coil command signal provided via a single conductor that is the basis for operating the first and second ignition coils supplying electrical energy to a single spark plug. The ignition coil command signal timing changes in response to engine speed, engine load, engine combustion mode (e.g., lean or dilute) among other variables. Short duration voltage pulses (e.g., a predetermined time such as less than 75 microseconds) as shown at 402 and 406 provide first (charge second ignition coil) and second instructions (discharge second ignition coil) for operating a second ignition coil. The dwell time for the second ignition coil is the time between the falling edge of the first voltage pulse of pulse 402 and the falling edge of second voltage pulse 406. Long duration voltage pulse with (e.g., a predetermined time longer than 105 microseconds) as shown at 404 provides the start charging time, discharge time, and dwell time for charging the first ignition coil. The start charging time for the first ignition coil is based on the rising edge of pulse 404. The discharge time for the first ignition coil is based on the falling edge of pulse 404. The dwell time for the first ignition coil is the time between the rising and falling edges of pulse 404. The discharge time corresponds to an engine crankshaft position for desired spark (e.g., 20 degrees BTDC).

The second plot from the top of FIG. 4 shows a second ignition coil charging current. The second ignition coil of the two ignition coils supplying energy to the lone spark plug is charging. The second ignition coil is increasing when the second ignition coil charging current signal is increasing in the direction of the vertical axis arrow. The second ignition coil is not charging when the second ignition coil charging current signal is at a lower level near the horizontal axis.

The following times are typical times for when the engine is operating at a speed of 6000 RPM. A time between time T10 and time T13 is 5 milliseconds. A time between time T12 and time T13 is 2 milliseconds. A time between time T11 and time T12 is 2 milliseconds. A time between time T10 and time T11 is 3 milliseconds. A time between time T10 and time T16 is 20 milliseconds. A time between time T12 and time T14 is 5 milliseconds. The duration of ignore window 410 is 5 milliseconds.

FIG. 4 shows an example sequence for mitigating the possibility of undesirable spark timing when a second of two voltage pulses commanding a second ignition coil (e.g., a discharge command for a second ignition coil) is missing or not detected during a cylinder cycle. During nominal operating conditions, three voltage pulses occur during each cycle of each cylinder. During the cylinder cycle, a second ignition coil begins charging in response to a falling edge of a first voltage pulse 402 (e.g., short duration less than 75 micro seconds) and discharges in response to a falling edge of a third voltage pulse 406 (e.g., short duration less than 75 micro seconds). A first ignition coil begins charging in response to a rising edge of second voltage pulse 404 (e.g., short duration less than 75 micro seconds), and the first ignition coil discharges in response to the falling edge of voltage pulse 404. However, in this example, the third voltage pulse or second portion of a command to operate the second ignition coil is missing as indicated by the dotted lines.

At time T10, the falling edge of a first voltage pulse representing a first portion of a command to operate the second ignition coil is received by interpretive logic 225 of FIG. 2. The interpretive logic initiates charging of the second ignition coil as indicated by the second charging coil current increasing. The first ignition coil is not charged and does not begin charging at time T10.

At time T11, the interpretive logic identifies the rising edge of the second voltage pulse 404 after it is at a high level for longer than 105 microseconds. The interpretive logic begins charging the first ignition coil (not shown). The second ignition coil continues charging.

At time T12, the interpretive logic identifies the falling edge of the second voltage pulse 404 and discharges the first ignition coil (not shown). The second ignition coil continues charging.

At time T13, the third voltage pulse (short duration) goes missing or undetected as indicated by the dotted lines. Because the third voltage pulse is undetected during the cylinder cycle, the second ignition coil continues to charge for a predetermined amount of time which ends at time T14. When the predetermined amount of time expires without detecting the third voltage pulse, commands for the second coil (e.g., voltage pulses less than 75 microseconds) are not excepted, processed, or responded to for a predetermined amount of time (e.g., 5 milliseconds) as indicated by the ignore window 410. Further, current supplied to the second ignition coil is ramped down at a predetermined rate that is much slower than an amount of time it takes to disrupt current flow into the second ignition coil when the second ignition coil is discharged in response to a falling edge of a third voltage pulse during a cylinder cycle. Consequently, discharging the second ignition coil at a slow rate does not induce a spark at the spark plug. Therefore, the second ignition coil is not discharged to induce a spark at the spark plug at a time later than spark is desired to be supplied during the cylinder cycle. In this way, a spark at an undesirable time may be avoided. The second ignition coil is discharged before time T16.

At time T16, a first voltage pulse (e.g., short duration of less than 75 micro seconds) for the second ignition coil during a second cylinder cycle (e.g., four strokes) is received by the interpretive logic. The second ignition coil begins charging shortly after the falling edge observed at time T16.

Between time T16 and time T17, a first ignition coil is charged and discharged in response to a second voltage pulse (e.g., a long duration voltage pulse greater than 105 microseconds) for the second ignition coil during the second engine cycle. The second ignition coil continues to charge.

At time T17, a second voltage pulse (e.g., short duration of less than 75 micro seconds) for the second ignition coil during a second engine cycle is received by the interpretive logic. The second ignition coil is discharged shortly after the falling edge of the second short duration voltage pulse is received during the second cylinder cycle. Discharging the second ignition coil increases electrical energy delivered to the spark plug during the cylinder cycle. Thus, spark timing resumes in an expected way after the both short duration voltage pulses are detected during the second cylinder cycle.

Commands for the second ignition coil (e.g., short duration pulse widths) are not responded to or no action is performed in response to short duration voltage pulses of the command signal in the second ignore window between time T17 and time T18. The ignore window has a duration of a predetermined amount of time.

In this way, mistiming of spark from a second ignition coil to a spark plug while a first ignition coil is discharging to the spark plug may be avoided. This may be particularly useful to avoid providing untimely spark during a subsequent cylinder cycle since delayed spark discharge may lead to providing spark during a subsequent cylinder cycle. Further, the ignore window 410 provides time for the second ignition coil to discharge to a low level where spark may not be provided at the spark plug via the second ignition coil at times after the ignore window and before subsequent second ignition coil commands are received in a subsequent cylinder cycle.

Referring now to FIG. 5, an example plot showing a way to mitigate ignition system degradation is shown. In particular, FIG. 5 shows example signals during conditions when a first short duration voltage pulse during a cylinder cycle (e.g., first voltage pulse during the cylinder cycle) is not present or is missing. The sequence of FIG. 5 may be provided by the method of FIG. 7 as part of the system of FIGS. 1 and 2. Vertical lines from time T20-T27 represent times of interest in the sequence. A first cylinder cycle begins at a time before T20 and ends before time T25. A second cylinder cycle begins at the end of the first cylinder cycle before time T25.

The first plot from the top of FIG. 5 shows an ignition coil command signal provided via a single conductor that is the basis for operating the first and second ignition coils supplying electrical energy to a single spark plug. The ignition coil command signal timing changes in response to engine speed, engine load, engine combustion mode (e.g., lean or dilute) among other variables. Short duration voltage pulses (e.g., a predetermined time such as less than 75 microseconds) as shown at 502 and 506 provide first (charge second ignition coil) and second instructions (discharge second ignition coil) for operating a second ignition coil. The dwell time for the second ignition coil is the time between the falling edge of the first voltage pulse of pulse 502 and the falling edge of second voltage pulse 506. Long duration voltage pulse with (e.g., a predetermined time longer than 105 microseconds) as shown at 504 provides the start charging time, discharge time, and dwell time for charging the first ignition coil. The start charging time for the first ignition coil is based on the rising edge of pulse 504. The discharge time for the first ignition coil is based on the falling edge of pulse 504. The dwell time for the first ignition coil is the time between the rising and falling edges of pulse 504. The discharge time corresponds to an engine crankshaft position for desired spark (e.g., 20 degrees BTDC).

The second plot from the top of FIG. 5 shows a second ignition coil charging current. The second ignition coil of the two ignition coils supplying energy to the lone spark plug is charging. The second ignition coil is increasing when the second ignition coil charging current signal is increasing in the direction of the vertical axis arrow. The second ignition coil is not charging when the second ignition coil charging current signal is at a lower level near the horizontal axis.

The following times are typical times for when the engine is operating at a speed of 6000 RPM. A time between time T20 and time T23 is 5 milliseconds. A time between time T22 and time T23 is 2 milliseconds. A time between time T21 and time T22 is 2 milliseconds. A time between time T20 and time T21 is 3 milliseconds. A time between time T20 and time T25 is 20 milliseconds. The duration of ignore window 510 is 10 milliseconds.

FIG. 5 shows an example sequence for mitigating the possibility of undesirable spark timing when a first of two voltage pulses commanding a second ignition coil (e.g., a charging command for the second ignition coil) is missing or not detected during a cylinder cycle. During nominal operating conditions, three voltage pulses occur during each cycle of each cylinder. During the cylinder cycle, a second ignition coil begins charging in response to a falling edge of a first voltage pulse 502 (e.g., short duration less than 75 micro seconds) and discharges in response to a falling edge of a third voltage pulse 506 (e.g., short duration less than 75 micro seconds). A first ignition coil begins charging in response to a rising edge of second voltage pulse 504 (e.g., short duration less than 75 micro seconds), and the first ignition coil discharges in response to the falling edge of voltage pulse 504. However, in this example, the first voltage pulse or first portion of a command to operate the second ignition coil is missing as indicated by the dotted lines.

At time T20, the falling edge of a first voltage pulse representing a first portion of a command to operate the second ignition coil is not received by interpretive logic 225 of FIG. 2. The location of the missing voltage pulse is indicated by the dotted lines at 502. The interpretive logic does not initiate charging of the second ignition coil as indicated by the second charging coil current not increasing. The first ignition coil is not charged and does not begin charging at time T20.

At time T21, the interpretive logic identifies the rising edge of the second voltage pulse 504 after it is at a high level for longer than 105 microseconds. The interpretive logic begins charging the first ignition coil (not shown). The second ignition coil does not charge.

At time T22, the interpretive logic identifies the falling edge of the second voltage pulse 504 and discharges the first ignition coil (not shown). The second ignition coil does not charge. In addition, an ignore window opens so that any short duration pulses are not acted upon (no coil charging or discharging) for a predetermined amount of time (e.g., 10 milliseconds). The duration of the ignore window is increased as compared to the condition where the third voltage pulse during the cylinder cycle goes missing so that charging of the ignition coil is delayed until a following cylinder cycle (e.g., a second cylinder cycle). By not responding to voltage pulses that are second ignition coil commands, mistimed spark events may be avoided.

At time T23, the third voltage pulse (short duration) is ignored so that the second ignition coil does not begin charging late in the first cylinder cycle. The charging of the second ignition coil may resume its regular procedure during the following or second cylinder cycle. This allows the second ignition coil to be charged to a desired level and to be discharged at a desired crankshaft angle.

At time T24, the ignore window closes and short duration voltage pulses may once again be interpreted as commands for the charging and discharging of the second ignition coil. The first and second ignition coils are not storing charge at time T24 and no ignition coil commands are present.

At time T25, a first voltage pulse (e.g., short duration of less than 75 micro seconds) for the second ignition coil during a second cylinder cycle (e.g., four strokes) is received by the interpretive logic. The second ignition coil begins charging shortly after the falling edge observed at time T25.

Between time T25 and time T26, a first ignition coil is also charged and discharged in response to a second voltage pulse (e.g., a long duration voltage pulse greater than 105 microseconds) for the second ignition coil during the second engine cycle. The second ignition coil continues to charge.

At time T26, a falling edge of a second voltage pulse (e.g., short duration of less than 75 micro seconds) for the second ignition coil during a second engine cycle is received by the interpretive logic. The second ignition coil is discharged shortly after the falling edge of the second short duration voltage pulse is received during the second cylinder cycle. Discharging the second ignition coil increases electrical energy delivered to the spark plug during the cylinder cycle. Thus, spark timing resumes in an expected way after the both short duration voltage pulses are detected during the second cylinder cycle.

In this way, mistiming of spark from a second ignition coil to a spark plug while a first ignition coil is discharging to the spark plug may be avoided. This may be particularly useful to avoid providing untimely spark during a subsequent cylinder cycle since the second ignition coil is not charged until a subsequent cylinder cycle. Further, the ignore window 510 inhibits the second ignition coil from charging so that a desired dwell time and amount of spark energy may be provided during the subsequent cylinder cycle.

Referring now to FIG. 6, an example plot showing a way to mitigate ignition system degradation is shown. Specifically, FIG. 6 shows example signals during conditions when a long duration voltage pulse (e.g., a first coil command) during a cylinder cycle is not present or missing. The sequence of FIG. 6 may be provided by the method of FIG. 7 as part of the system of FIGS. 1 and 2. Vertical lines from time T30-T37 represent times of interest in the sequence. A first cylinder cycle begins at a time before T30 and ends before time T34. A second cylinder cycle begins at the end of the first cylinder cycle before time T34.

The first plot from the top of FIG. 6 shows an ignition coil command signal provided via a single conductor that is the basis for operating the first and second ignition coils supplying electrical energy to a single spark plug. The ignition coil command signal timing changes in response to engine speed, engine load, engine combustion mode (e.g., lean or dilute) among other variables. Short duration voltage pulses (e.g., a predetermined time such as less than 75 microseconds) as shown at 602 and 606 provide first (charge second ignition coil) and second instructions (discharge second ignition coil) for operating a second ignition coil. The dwell time is the time between the falling edge of the first voltage pulse of pulse 602 and the falling edge of second voltage pulse 606. Long duration voltage pulse with (e.g., a predetermined time longer than 105 microseconds) as shown at 604 provides the start charging time, discharge time, and dwell time for charging the first ignition coil. The start charging time is based on the rising edge of pulse 604. The discharge time is based on the falling edge of pulse 604. The dwell time is the time between the rising and falling edges of pulse 604. The discharge time corresponds to an engine crankshaft position for desired spark (e.g., 20 degrees BTDC).

The second plot from the top of FIG. 6 shows a second ignition coil charging current. The second ignition coil of the two ignition coils supplying energy to the lone spark plug is charging. The second ignition coil is increasing when the second ignition coil charging current signal is increasing in the direction of the vertical axis arrow. The second ignition coil is not charging when the second ignition coil charging current signal is at a lower level near the horizontal axis.

The following times are typical times for when the engine is operating at a speed of 6000 RPM. A time between time T30 and time T33 is 5 milliseconds. A time between time T32 and time T33 is 2 milliseconds. A time between time T31 and time T32 is 2 milliseconds. A time between time T30 and time T31 is 3 milliseconds. A time between time T30 and time T34 is 20 milliseconds. The duration of ignore window 610 is 10 milliseconds beyond a falling edge of a second (long) voltage pulse during a next cylinder cycle.

FIG. 6 shows an example sequence for mitigating the possibility of undesirable spark timing when a second voltage pulse of a cylinder that represents a command for a first ignition coil is missing or not detected during a cylinder cycle. During nominal operating conditions, three voltage pulses occur during each cycle of each cylinder. During the cylinder cycle, a second ignition coil begins charging in response to a falling edge of a first voltage pulse 602 (e.g., short duration less than 75 micro seconds) and discharges in response to a falling edge of a third voltage pulse 606 (e.g., short duration less than 75 micro seconds). A first ignition coil begins charging in response to a rising edge of second voltage pulse 604 (e.g., long duration greater than 105 micro seconds), and the first ignition coil discharges in response to the falling edge of voltage pulse 604. However, in this example, the second voltage pulse or the command to operate the first ignition coil is missing as indicated by the dotted lines.

At time T30, the falling edge of a first voltage pulse representing a first portion of a command to operate the second ignition coil is received by interpretive logic 225 of FIG. 2. The interpretive logic initiates charging of the second ignition coil as indicated by the second charging coil current increasing. The first ignition coil is not charged and does not begin charging at time T30.

At time T31, the interpretive logic fails to identify the rising edge of the second voltage pulse 604 since it is missing. The interpretive logic allows the second ignition coil to continue charging. The first ignition coil is not storing charge and is not being charged.

At time T32, the interpretive logic fails to identify the falling edge of the second voltage pulse 604 and so the first ignition coil is not discharged. Further, charging of the second ignition coil continues.

At time T33, the third voltage pulse in a regular cylinder cycle is detected, but the second ignition coil is not discharged because the second coil discharge time would be late. Consequently, the content of the cylinder in which the second voltage pulse is missing is expelled without being combusted. Further, current supplied to the second ignition coil is gradually ramped down to reduce the charge stored in the second ignition coil. An ignore window is also open and while the ignore window is open, the interpretive logic does not respond to short duration or second ignition coil commands. By not responding to second ignition coil commands, it may be possible to reduce the possibility of losing synchronization between the command signal and engine crankshaft position. Therefore, spark events may occur at desired timings or not at all during a cylinder cycle.

Between time T33 and time T34, a second ignition coil is slowly discharged so as to not induce a spark at a spark plug that is in electrical communication with the second ignition coil. The charge in the second ignition coil is reduced so that a desired amount of charge is stored in the second ignition coil when the second ignition coil is subsequently charged.

At time T34, a first voltage pulse (e.g., short duration) for the second ignition coil during a second cylinder cycle is received by the interpretive logic. Nevertheless, because the ignore window 620 is open, the interpretive logic does not begin charging the second ignition coil.

Between time T34 and time T35 the second voltage pulse (e.g., the long duration pulse) is received and detected by the interpretive logic. The interpretive logic may begin charging of the first ignition coil in response to a rising edge of the second voltage pulse. Alternatively, the interpretive logic may delay charging both the first and second ignition coils until a predetermined amount of time (e.g., 10 milliseconds) after a falling edge of the second voltage pulse is detected. In this way, the interpretive logic may inhibit spark production in a cylinder until all three voltage pulse commands are detected in a cylinder cycle to reduce the possibility of mistimed spark. Thus, early or late combustion of the cylinder contents may be avoided.

At time T35, a falling edge of the second voltage pulse is detected by the interpretive logic. The falling edge is the basis for closing the ignore window so that short duration voltage pulses or second coil commands may be interpreted and used to charge and discharge the second ignition coil. The ignore window is closed a predetermined amount of time (e.g., 10 milliseconds) after the falling edge of the second voltage pulse is detected.

At time T36, a second voltage pulse (e.g., short duration of less than 75 micro seconds, the third voltage pulse in the cylinder cycle) for the second ignition coil during a second engine cycle is received by the interpretive logic. However, the second ignition coil is not discharged or charge in response to the voltage pulse. Rather, the interpretive logic does not respond to the voltage pulse. In this way, undesired charging of the second ignition coil may be avoided.

At time T37, the ignore window closes so that first, second, and third voltage pulses may be acted upon during a cylinder cycle. This allows the first and second ignition coils to charge and discharge, thereby resuming normal operation.

In this way, mistiming of spark from a second ignition coil to a spark plug may be avoided when first ignition coil commands are not present or detected. As a result, it may be possible to avoid untimely spark events during a subsequent cylinder cycles.

Referring now to FIG. 7, a method for mitigating the possibility of undesirable spark events for a dual coil ignition system is shown. The ignition system may be similar to the ignition system shown in FIG. 2. Additionally, at least portions of the method of FIG. 7 may be included as executable instructions in the system of FIG. 1. Further, at least portions of the method of FIG. 7 may be actions taken within the ignition coil in the physical world to transform ignition operation. The method of FIG. 7 may be applied to ignition coils of all engine cylinders. The first ignition coil may be 206 of FIG. 2 and the second ignition coil may be 208 of FIG. 2. The description of first, second, and third pulse widths used in the method of FIG. 7 apply to pulse widths that are present if the ignition system is operating without degradation even though for specific conditions one of the first, second, or third pulse widths may be missing.

At 702, method 700 begins to monitor an ignition coil command signal for a cylinder cycle. The ignition coil command signal may include voltage pulses that are the basis for operating two ignition coils that provide electrical energy to a single spark plug. In one example, the command signal may be of the form described in FIGS. 3-6. Method 700 monitors the command signal for short (e.g., less than 75 microseconds) and long duration voltage pulses (e.g., greater than 105 microseconds). Further, method 700 detects rising and falling edges of voltage pulses. The command signal is synchronized with engine crankshaft position so that the voltage pulse edges indicate desired crankshaft positions for discharging spark during a cylinder cycle. Method 700 proceeds to 704 after beginning to monitor the command signal.

At 704, method 700 judges if a first voltage pulse (e.g., short duration pulse width) of an ignition coil command sequence for a cylinder cycle is missing. Method 700 may judge that the first voltage pulse of the ignition coil command sequence for a cylinder cycle is missing when the first voltage pulse has not been detected before a second voltage pulse (e.g., long duration pulse width) for the ignition coil command sequence is detected. The first voltage pulse is a begin charging command for a second ignition coil. The second voltage pulse indicates charging and discharging time for the first ignition coil. For example, if a short duration voltage pulse is not detected by interpretive logic before a long duration voltage pulse is detected, it may be determined that the first voltage pulse for a cylinder cycle is absent or missing. In other examples, it may be determined that the first voltage pulse is not present if the engine rotates through a crankshaft angle without detecting the first voltage pulse. If method 700 judges that the first voltage pulse is missing, the answer is yes and method 700 proceeds to 706. Otherwise, the answer is no and method 700 proceeds to 708.

At 706, method 700 opens an ignore window after a falling edge of a second voltage pulse (e.g., long duration pulse width) is detected. By opening the ignore window, short duration (e.g., second ignition coil commands) pulses are not acted upon to charge or discharge the second ignition coil. Alternatively, the ignore window may be opened at a predetermined crankshaft angle during the cylinder cycle.

FIG. 5 shows an example of the way method 700 opens the ignore window and does not respond to short duration voltage pulses that occur during the time the ignore window is open so that the second ignition coil is not charged in a cylinder cycle when the first voltage pulse is missing or not detected. For example, if the first voltage pulse of a cylinder cycle is missing and the third voltage pulse is present, the third voltage pulse does not cause the second ignition coil to charge or discharge as is shown in FIG. 5. The ignore window is opened for a predetermined amount of time or crankshaft degree interval. Method 700 proceeds to exit after the ignore window is opened and closed as described in FIG. 5.

At 708, method 700 judges if a second voltage pulse (e.g., long duration pulse width) of an ignition coil command sequence for a cylinder cycle is missing. Method 700 may judge that the second voltage pulse of the ignition coil command sequence for a cylinder cycle is missing when a third voltage pulse of the ignition coil command sequence has been detected without detecting the second voltage pulse in the cylinder cycle. The first voltage pulse is a begin charging command for a second ignition coil. The second voltage pulse indicates charging and discharging time for the first ignition coil. The third voltage pulse indicates the discharge time for the second ignition coil. In other examples, it may be determined that the second voltage pulse is not present if the engine rotates through a crankshaft angle without detecting the second voltage pulse. If method 700 judges that the second voltage pulse is missing, the answer is yes and method 700 proceeds to 710. Otherwise, the answer is no and method 700 proceeds to 712.

At 710, method 700 opens an ignore window after a falling edge of a third voltage pulse (e.g., short duration pulse width) is detected as shown in FIG. 6. By opening the ignore window, short duration (e.g., second ignition coil commands) pulses are not acted upon to charge or discharge the second ignition coil. Further, the charging current of the second ignition coil is slowly reduced so as to not induce spark at a spark plug that is in electrical communication with the second ignition coil. Alternatively, the ignore window may be opened at a predetermined crankshaft angle during the cylinder cycle. FIG. 6 shows an example of the way method 700 opens the ignore window and does not respond to short duration voltage pulses that occur during the time the ignore window is open so that the second ignition coil is not discharged in a cylinder cycle when the second voltage pulse is missing or not detected. For example, if the second voltage pulse of a cylinder cycle is missing and the third voltage pulse is present, the second ignition coil is not discharged when the third voltage pulse is detected as is shown in FIG. 6. The ignore window is opened for a predetermined amount of time or crankshaft degree interval. In one example the ignore window is open for 10 milliseconds after a falling edge of a second voltage pulse is detected in a next cylinder cycle as is shown in FIG. 6. Method 700 proceeds to exit after the ignore window is opened and closed as described in FIG. 6.

At 712, method 700 judges if a third voltage pulse (e.g., short duration pulse width) of an ignition coil command sequence for a cylinder cycle is missing. Method 700 may judge that the third voltage pulse of the ignition coil command sequence for a cylinder cycle is missing when the third voltage pulse has not been detected a predetermined amount of time after the first or second voltage pulse (e.g., short or long duration pulse width) during the cylinder cycle is detected. The third voltage pulse is a discharge command for a second ignition coil. For example, if a short duration voltage pulse is not detected by interpretive logic after a long duration voltage pulse is detected, it may be determined that the third voltage pulse for a cylinder cycle is absent or missing. In other examples, it may be determined that the third voltage pulse is not present if the engine rotates through a crankshaft angle without detecting the third voltage pulse. If method 700 judges that the third voltage pulse is missing, the answer is yes and method 700 proceeds to 714. Otherwise, the answer is no and method 700 proceeds to 716.

At 714, method 700 opens an ignore window a predetermined amount of time after a falling edge of the second voltage pulse (e.g., long duration pulse width) is detected. By opening the ignore window, short duration (e.g., second ignition coil commands) pulses are not acted upon to charge or discharge the second ignition coil. Alternatively, the ignore window may be opened at a predetermined crankshaft angle during the cylinder cycle after the third voltage pulse is not detected. FIG. 4 shows an example of the way method 700 opens the ignore window and does not respond to short duration voltage pulses that occur during the time the ignore window is open so that the second ignition coil is not charged in a cylinder cycle when the first voltage pulse is missing or not detected. For example, if the third voltage pulse of a cylinder cycle is missing and the first and second voltage pulses are present, the third voltage pulse does not cause the second ignition coil to discharge as is shown in FIG. 4. The ignore window is opened for a predetermined amount of time or crankshaft degree interval. Further, charge in the second ignition coil is slowly reduced over time by reducing charging current supplied to the second ignition coil so that the second ignition coil does not induce a spark at a spark plug that is electrically coupled to the second ignition coil during the cylinder cycle as is shown in FIG. 4. Method 700 proceeds to exit after the ignore window is opened and closed as described in FIG. 4.

At 716, method 700 charges and discharges first and second ignition coils during a cylinder of a cylinder to provide spark to the cylinder. In one example as shown in FIG. 3, method 700 charges a second ignition coil in response to a first voltage pulse during a cylinder cycle. Method 700 charges and discharges a first ignition coil in response to a second voltage pulse during the cylinder cycle. Method 700 discharges the second ignition coil in response to a third pulse during the cylinder cycle. Thus, two commands to two different ignition coils are provided via three voltage pulses. The voltage pulses are distinguished from each other by the duration of the voltage pulses. Longer duration voltage pulses are commands for the first ignition coil. Shorter duration voltage pulses are commands for the second ignition coil. Method 700 proceeds to exit after spark is provided during a cylinder cycle as is shown in FIG. 3.

In this way, charging and discharging of the second ignition coil during a cylinder cycle may be prevented in response to one or more missing voltage pulses that comprise an ignition coil command sequence. Further, the method provides for soft shutdown of the second ignition coil if the second ignition coil has started to charge and a missing second or third voltage pulse is determined.

Thus, the method of FIG. 7 provides for a method for providing spark to an engine, comprising: commanding two different ignition coil charging current times via a single conductor and two ignition coil commands; and ignoring a second portion of a first of the two ignition coil commands in response to an absence of a first portion of the first of the two ignition coil commands. The method includes where two ignition coil commands are provided during a single cycle of a cylinder. The method includes where the two ignition coil commands are directed to a first ignition coil and a second ignition coil, and further comprising not charging and discharging the first ignition coil and the second ignition coil in a cylinder cycle in response to the absence of the first portion of the first of the two ignition coil commands in the cylinder cycle.

In some examples, the method includes where the two ignition coil commands include a command to a first ignition coil comprising a single voltage pulse. The method includes where the two ignition coil commands include a command to a second ignition coil comprising of two voltage pulses. The method includes where ignoring the second portion of the first of two ignition coil commands includes taking no action to charge or discharge an ignition coil in response to presence of a voltage pulse.

The method of FIG. 7 also provides for a method for providing spark to an engine, comprising: commanding two different ignition coil charging current times via a single conductor and two ignition coil commands for a cylinder cycle; and ignoring the presence of at least one voltage pulse providing at least a portion of the two ignition coil commands in response to a voltage pulse missing from the two ignition coil commands. The method includes where the two ignition coil commands are comprised of at least three separate voltage pulses of two pulse widths.

In some examples, the method includes where ignoring the presence of the at least one voltage pulse includes not charging or discharging an ignition coil in response to a presence voltage pulse. The method includes where a second ignition coil is not charged in the cylinder cycle in response to an absence of a first portion of a first command of the two ignition coil commands. The method includes where a second ignition coil is not discharged to provide a spark at a spark plug in the cylinder cycle in response to an absence of a second command of the two ignition coil commands. The method includes where a second ignition coil is not discharged to provide a spark at a spark plug in the cylinder cycle in response to an absence of a second portion of a first command of the two ignition coil commands. The method includes where the two ignition coil commands are a basis for providing spark at a single spark plug. The method further comprises charging and discharging a first ignition coil in response to a voltage pulse of a second command of the two ignition coil commands.

In still other examples, the method provides for providing spark to an engine, comprising: commanding two different ignition coil charging current times via a single conductor and two ignition coil commands, a first of the two ignition coil commands adjusting charging of a second ignition coil, a second of the two ignition coil commands adjusting charging of a first ignition coil; adjusting charging of the second ignition coil responsive to an absence of a first portion of the first of the two ignition coil commands in a first manner; adjusting charging of the second ignition coil responsive to an absence of a second portion of the first of the two ignition coil commands in a second manner; and adjusting charging of a first ignition coil responsive to an absence of a second of the two ignition coil commands in a third manner.

The method includes where two ignition coil commands are provided during a single cycle of a cylinder, and where the first manner includes not charging the second ignition coil in a cylinder cycle where the first portion of the first of the two ignition coil commands is absent. The method includes where the two ignition coil commands are directed to the first ignition coil and the second ignition coil, and where the second manner includes continuing to charge the second ignition coil in a cylinder cycle where the second portion of the first of the two ignition coil commands is absent. The method includes where the two ignition coil commands include a command to a first ignition coil comprising a single voltage pulse, and where the third manner includes charging and discharging the second ignition coil without providing a spark at a spark plug in a cylinder cycle where the second of the two ignition coil commands is absent. The method includes where the two ignition coil commands include a command to a second ignition coil comprising two voltage pulses. The method includes where a spark is not induced at a spark plug coupled to the second ignition coil when adjusting charging of the second ignition coil in the first and second manners.

As will be appreciated by one of ordinary skill in the art, routines described in FIG. 7 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but it is provided for ease of illustration and description. The methods and sequences described herein may be provided via executable instructions stored in non-transitory memory of a control in the system or systems described herein. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, or alternative fuel configurations could use the present description to advantage.

The invention claimed is:

1. A method for an engine, comprising:

commanding two different ignition coil charging current times via a single conductor and two ignition coil commands for a cylinder cycle; and ignoring a presence of at least one voltage pulse providing at least a portion of the two ignition coil commands in response to a voltage pulse missing from the two ignition coil commands.

2. The method of claim 1, where the two ignition coil commands are comprised of at least three separate voltage pulses of two pulse widths, and where ignoring includes not charging or discharging an ignition coil.

3. The method of claim 2, where ignoring the presence of the at least one voltage pulse includes not charging or discharging an ignition coil in response to a present voltage pulse.

4. The method of claim 1, where a second ignition coil is not charged in the cylinder cycle in response to an absence of a first portion of a first command of the two ignition coil commands.

5. The method of claim 1, where a second ignition coil is not discharged to provide a spark at a spark plug in the cylinder cycle in response to an absence of a second command of the two ignition coil commands.

6. The method of claim 1, where a second ignition coil is not discharged to provide a spark at a spark plug in the cylinder cycle in response to an absence of a second portion of a first command of the two ignition coil commands.

7. The method of claim 1, where the two ignition coil commands are a basis for providing spark at a single spark plug.

8. The method of claim 1, further comprising charging and discharging a first ignition coil in response to a voltage pulse of a second command of the two ignition coil commands.

9. A method for an engine, comprising:

commanding two different ignition coil charging current times via a single conductor and two ignition coil commands, a first of the two ignition coil commands adjusting charging of a second ignition coil, a second of the two ignition coil commands adjusting charging of a first ignition coil;

adjusting charging of the second ignition coil responsive to an absence of a first portion of the first of the two ignition coil commands in a first manner;

adjusting charging of the second ignition coil responsive to an absence of a second portion of the first of the two ignition coil commands in a second manner; and adjusting charging of the first ignition coil responsive to an absence of the second of the two ignition coil commands in a third manner.

10. The method of claim 9, where the two ignition coil commands are provided during a single cycle of a cylinder, and where the first manner includes not charging the second ignition coil in a cylinder cycle where the first portion of the first of the two ignition coil commands is absent.

11. The method of claim 9, where the two ignition coil commands are directed to the first ignition coil and the second ignition coil, and where the second manner includes continuing to charge the second ignition coil in a cylinder cycle where the second portion of the first of the two ignition coil commands is absent.

12. The method of claim 9, where the two ignition coil commands include a command to the first ignition coil comprising a single voltage pulse, and where the third manner includes charging and discharging the second ignition coil without providing a spark at a spark plug in a cylinder cycle where the second of the two ignition coil commands is absent.

13. The method of claim 12, where the two ignition coil commands include a command to the second ignition coil comprising two voltage pulses.

14. The method of claim 9, where a spark is not induced at a spark plug coupled to the second ignition coil when adjusting charging of the second ignition coil in the first and second manners.

* * * * *